US007292816B2

(12) United States Patent
Ojimi et al.

(10) Patent No.: US 7,292,816 B2
(45) Date of Patent: Nov. 6, 2007

(54) METHOD AND APPARATUS FOR ELECTROPHOTOGRAPHIC IMAGE FORMING CAPABLE OF EFFECTIVELY REMOVING RESIDUAL TONER, A CLEANING MECHANISM USED THEREIN, A PROCESS CARTRIDGE INCLUDING THE CLEANING MECHANISM USED IN THE APPARATUS, AND TONER USED IN THE APPARATUS

(75) Inventors: Tokuya Ojimi, Kawasaki (JP); Toshio Koike, Kawasaki (JP); Takaaki Tawada, Yokohama (JP); Takeshi Shintani, Kawasaki (JP); Yuji Arai, Kawasaki (JP); Takuzi Yoneda, Ohta-ku (JP); Masanori Kawasumi, Yokohama (JP); Masami Tomita, Numazu (JP); Ken Amemiya, Nerima-ku (JP); Shinichi Kawahara, Katsushika-ku (JP)

(73) Assignee: Ricoh Co., Ltd., Tokyo (JP)

( * ) Notice: Subject to any disclaimer, the term of this patent is extended or adjusted under 35 U.S.C. 154(b) by 0 days.

(21) Appl. No.: 11/100,813

(22) Filed: Apr. 7, 2005

(65) Prior Publication Data

US 2005/0232666 A1 Oct. 20, 2005

(30) Foreign Application Priority Data

Apr. 7, 2004 (JP) ..... 2004-112681

(51) Int. Cl.
*G03G 21/00* (2006.01)

(52) U.S. Cl. ..... 399/346; 399/350

(58) Field of Classification Search ..... 399/346, 399/350

See application file for complete search history.

(56) References Cited

U.S. PATENT DOCUMENTS 4,562,136 A 12/1985 Inoue et al.

(Continued)

FOREIGN PATENT DOCUMENTS

EP 0 984 340 A2 3/2000

(Continued)

OTHER PUBLICATIONS

U.S. Appl. No. 11/512,385, filed Aug. 30, 2006, Tomita.

*Primary Examiner*—Quana Grainger
(74) *Attorney, Agent, or Firm*—Oblon, Spivak, McClelland, Maier & Neustadt, P.C.

(57) ABSTRACT

An image forming apparatus includes an image bearing member configured to bear an electrostatic latent image on a surface thereof, a developing mechanism configured to develop the electrostatic latent image formed on the surface of the image bearing member into a toner image with toner, a transfer mechanism configured to transfer the toner image from the image bearing member to an image receiver, and a cleaning mechanism including a cleaning blade configured to scrape a residual toner on the surface of the image bearing member after the toner image is transferred to the image receiver, the cleaning blade disposed in contact with the image bearing member and having a JIS-A hardness equal to or more than 70 and a repulsion elasticity equal to or less than 30%, and a friction reducing member configured to reduce a coefficient of friction on the surface of the image bearing member.

52 Claims, 5 Drawing Sheets

U.S. PATENT DOCUMENTS 4,590,141 A 5/1986 Aoki et al.
4,758,489 A 7/1988 Tomita et al.
4,762,763 A 8/1988 Nomura et al.
4,888,263 A 12/1989 Tomita et al.
4,931,374 A 6/1990 Tomita et al.
5,164,774 A 11/1992 Tomita et al.
5,225,303 A 7/1993 Tomita et al.
5,244,765 A 9/1993 Katoh et al.
5,384,628 A 1/1995 Takami et al.
5,474,869 A 12/1995 Tomita et al.
5,493,365 A 2/1996 Matsui et al.
5,572,293 A 11/1996 Kikuchi et al.
5,596,395 A 1/1997 Sawamura et al.
5,610,691 A 3/1997 Takahashi et al.
5,721,083 A 2/1998 Masuda et al.
5,761,594 A 6/1998 Seto et al.
5,840,456 A 11/1998 Tomita et al.
5,851,716 A 12/1998 Kuramoto et al.
5,887,224 A 3/1999 Mizuishi et al.
5,909,609 A 6/1999 Yahata et al.
5,915,143 A 6/1999 Watanabe et al.
5,923,936 A 7/1999 Tanoue et al.
5,950,062 A 9/1999 Yahata et al.
6,006,050 A 12/1999 Watanabe et al.
6,055,388 A 4/2000 Watanabe et al.
6,074,794 A 6/2000 Fushimi et al.
6,085,062 A 7/2000 Mizuishi et al.
6,103,441 A 8/2000 Tomita et al.
6,128,449 A 10/2000 Zenba et al.
6,144,811 A 11/2000 Ohori et al.
6,144,822 A 11/2000 Yamaguchi et al.
6,148,161 A 11/2000 Usui et al.
6,160,969 A 12/2000 Ishigaki et al.
6,226,481 B1 5/2001 Yoneda et al.
6,266,501 B1 7/2001 Mizuishi et al.
6,269,228 B1 7/2001 Kayahara et al.
6,337,957 B1 1/2002 Tamaki et al.
6,363,229 B1 3/2002 Shiraishi et al.
6,505,024 B2 1/2003 Kayahara et al.
6,507,718 B2 1/2003 Ohjimi et al.
6,522,855 B1 2/2003 Terai et al.
6,597,881 B2 7/2003 Hatori et al.
6,615,013 B2 9/2003 Arai et al.
6,628,903 B1 9/2003 Ohori et al.
6,628,912 B2 9/2003 Amemiya et al.
6,640,076 B2 10/2003 Shintani
6,654,574 B2 11/2003 Kayahara et al.
6,660,443 B2 12/2003 Sugiyama et al.
6,682,866 B2 1/2004 Sugiyama et al.
6,687,474 B2 2/2004 Yamada et al.
6,701,118 B2 3/2004 Kayahara et al.
6,740,460 B2 5/2004 Tomita et al.
6,756,175 B2 6/2004 Yamada et al.
6,757,505 B2 6/2004 Amemiya et al.
6,787,280 B2 9/2004 Yamashita et al.
6,800,412 B2 10/2004 Sugiyama et al.
6,807,390 B2 10/2004 Suda et al.
6,813,467 B2 11/2004 Kawahara et al.
6,824,945 B2 11/2004 Emoto et al.
6,829,461 B2 12/2004 Arai et al.
6,835,519 B2 12/2004 Sugiyama et al.
6,846,604 B2 1/2005 Emoto et al.
6,849,369 B2 2/2005 Yagi et al.
6,852,462 B2 2/2005 Emoto et al.
6,856,774 B2 2/2005 Sampe et al.
6,873,814 B2 3/2005 Ohjimi
7,014,969 B2 * 3/2006 Yachi et al. ..... 430/108.7
2001/0044059 A1 11/2001 Miyamoto et al.
2002/0098436 A1 7/2002 Miyamoto et al.
2003/0027066 A1 2/2003 Yamashita et al.
2003/0055159 A1 3/2003 Yamashita et al.
2003/0077536 A1 4/2003 Yamashita et al.
2003/0096185 A1 * 5/2003 Yamashita et al. ..... 430/109.4
2003/0180644 A1 9/2003 Nanya et al.
2003/0185585 A1 10/2003 Kimura et al.
2003/0215269 A1 11/2003 Kayahara et al.
2003/0219289 A1 11/2003 Kawahara et al.
2004/0052560 A1 3/2004 Ishii et al.
2004/0053154 A1 3/2004 Tomita et al.
2004/0071475 A1 4/2004 Ohori et al.
2004/0071476 A1 4/2004 Iwasaki et al.
2004/0076901 A1 4/2004 Miyamoto et al.
2004/0096239 A1 5/2004 Hosokawa et al.
2004/0106057 A1 6/2004 Tomita et al.
2004/0109706 A1 6/2004 Kosuge et al.
2004/0126147 A1 7/2004 Kondo et al.
2004/0131381 A1 7/2004 Kawasumi et al.
2004/0131961 A1 7/2004 Watanabe et al.
2004/0136763 A1 7/2004 Murakami et al.
2004/0141779 A1 7/2004 Yanagida et al.
2004/0142265 A1 7/2004 Tomita et al.
2004/0170446 A1 9/2004 Nagashima et al.
2004/0170447 A1 9/2004 Arai et al.
2004/0170455 A1 9/2004 Shintani et al.
2004/0175641 A1 9/2004 Nanya et al.
2004/0184841 A1 9/2004 Tsuda et al.
2004/0202495 A1 10/2004 Koike et al.
2004/0209181 A1 10/2004 Higuchi et al.
2004/0213597 A1 10/2004 Yanagida et al.
2004/0223782 A1 11/2004 Hosokawa et al.
2004/0233790 A1 11/2004 Hosokawa et al.
2004/0253022 A1 12/2004 Arai et al.
2004/0258432 A1 12/2004 Hatori et al.
2004/0265011 A1 12/2004 Tsuda et al.
2005/0002705 A1 1/2005 Shintani et al.
2005/0019070 A1 1/2005 Suda et al.
2005/0025520 A1 2/2005 Murakami et al.
2005/0036805 A1 2/2005 Murakami et al.
2005/0036810 A1 2/2005 Murakami et al.
2005/0232666 A1 10/2005 Ojimi et al.

FOREIGN PATENT DOCUMENTS

EP 1 220 055 A2 7/2002
EP 1 288 737 A1 3/2003
EP 1 403 742 A2 3/2004
JP 11-184340 9/1999
JP 2004295065 A * 10/2004

* cited by examiner

METHOD AND APPARATUS FOR ELECTROPHOTOGRAPHIC IMAGE FORMING CAPABLE OF EFFECTIVELY REMOVING RESIDUAL TONER, A CLEANING MECHANISM USED THEREIN, A PROCESS CARTRIDGE INCLUDING THE CLEANING MECHANISM USED IN THE APPARATUS, AND TONER USED IN THE APPARATUS

CROSS-REFERENCE TO RELATED APPLICATIONS

This application claims priority to Japanese patent application No. 2004-112681 filed on Apr. 7, 2004, the entire contents of which are hereby incorporated herein by reference.

BACKGROUND OF THE INVENTION

1. Field of the Invention

The present invention relates to a method and apparatus for image forming capable of effectively removing residual toner from an image bearing member with a cleaning member having optimal degrees of hardness and repulsion elasticity, a cleaning mechanism used in the apparatus, a process cartridge including the cleaning mechanism in the apparatus, and toner used in the apparatus.

2. Discussion of the Background

Generally, an image forming apparatus employing an electrophotographic method includes an image bearing member, a charging mechanism, an optical writing mechanism, a developing mechanism, an image transfer mechanism, and a cleaning mechanism, and performs image forming operations as follows. The charging mechanism uniformly charges the image bearing member. The optical writing mechanism then irradiates the image bearing member to form an electrostatic latent image. The developing mechanism subsequently develops the electrostatic latent image to a toner image. The image transfer mechanism receives the toner image on an image transfer member or a recording medium conveyed by a transfer member, so that the toner image can be fixed in a fixing mechanism and be discharged to a discharging tray or the like. After the toner image is transferred to the image transfer mechanism, the cleaning mechanism removes toner remaining on the image bearing member.

The cleaning mechanism with respect to an image bearing member generally includes a blade cleaning method, a fur brush cleaning method, a magnet brush cleaning method, or the like. Generally, the blade cleaning method is used because of its small size and low cost.

Recently, color image forming apparatuses using the electrophotographic image forming method have been widely used, digitalized images are easily available, and printed images are required to have higher image definitions. While higher image resolution and gradient are studied, the toner visualizing the electrostatic latent image is studied to have further sphericity and smaller particle diameter to form high definition images. Since the toner prepared by pulverizing methods has a limit of these properties, polymerized toners prepared by suspension polymerizing methods, emulsification polymerizing methods, and dispersion polymerizing methods capable of conglobating the toner and making the toner have a small particle diameter are being used.

The small toner having a substantially spherical shape is known to have a poor cleaning ability. Since background image forming apparatuses have used a cleaning blade formed by a rubber material for removing the toner prepared by pulverizing methods, the cleaning blade cannot stop the toner from falling through a space between an image bearing member and the cleaning blade into an inside of the image forming apparatus. Any toner that falls through the space may cause further abrasion of the cleaning blade, which may result in a shorter life of the cleaning blade. The toner also may adhere to a charging roller of the charging mechanism, which may result in a toner filming to produce defect images. Reducing a coefficient of friction of an image bearing member may work to improve a margin of cleaning ability of the cleaning blade, but may not be sufficiently effective to prevent the toner from falling through the space between the image bearing member and the cleaning blade.

The coefficient of friction of the image bearing member may be reduced by including a fluorocarbon resin on the surface thereof so that durability can be increased and a curl of a leading edge of the cleaning blade can be prevented. However, the above-described image bearing member may not surely remove the toner having a degree of sphericity equal to or greater than 0.93.

Further, better cleaning ability may be obtained by mixing zinc stearate into a toner particle and applying zinc stearate to the image bearing member. However, there may be various restrictions due to a mixing ratio of zinc stearate and intervals of the application.

SUMMARY OF THE INVENTION

The present invention has been made in view of the above-described circumstances.

An object of the present invention is to provide a novel electrophotographic image forming apparatus capable of more effectively removing toner from an image bearing member with a cleaning member having optimal degrees of hardness and repulsion elasticity.

Another object of the present invention is to provide a novel method of image forming capable of performing the above-described image forming operations more effectively removing toner from the image bearing member with the cleaning member.

Another object of the present invention is to provide a novel cleaning unit included in the above-described image forming apparatus having the cleaning member.

Another object of the present invention is to provide a novel process cartridge including the image bearing member and the above-described cleaning unit.

These and/or other objects can be provided by a novel image forming apparatus including an image bearing member, a charging mechanism, an optical writing mechanism, a developing mechanism, a transfer mechanism, and a cleaning mechanism. The image bearing member is configured to bear an image on a surface thereof. The charging mechanism is configured to uniformly charge the surface of the image bearing member. The optical writing mechanism is configured to form the electrostatic latent image on the surface of the image bearing member based on image data. The developing mechanism is configured to develop the electrostatic latent image formed on the surface of the image bearing member into a toner image with toner. The transfer mechanism is configured to transfer the toner image from the image bearing member to an image receiver. The cleaning mechanism includes a cleaning blade and a friction reducing member. The cleaning blade is configured to scrape a residual toner on the surface of the image bearing member after the toner image is transferred to the image receiver. The cleaning blade is disposed in contact with the image bearing member, and has a JIS-A hardness equal to or more than 70 and a repulsion elasticity equal to or less than 30%. The friction reducing member is configured to reduce a coefficient of friction on the surface of the image bearing member.

The cleaning blade may have an elongation at break equal to or greater than 20 MPa of 300% modulus.

The cleaning blade may have an elongation at break equal to or greater than 200% modulus.

The friction reducing member may include a brush member disposed in contact with the image bearing member and configured to apply a lubricant to the surface of the image bearing member.

The cleaning blade may be disposed downstream of a contact position of the brush member and the image bearing member in a rotation direction of the image bearing member.

The brush member may be configured to rotate in a same direction as the image bearing member at the contact position with the image bearing member.

At least the image bearing member and the cleaning mechanism may be integrally assembled in a process cartridge detachably attached to the image forming apparatus.

The above-described novel image forming apparatus may be configured to use the toner having a volume-based average particle diameter equal to or less than 10 μm and a distribution from approximately 1.00 to approximately 1.40, in which the distribution is defined by a ratio of the volume-based average particle diameter to a number-based average diameter.

The above-described novel image forming apparatus may be configured to use as the toner, toner having an average circularity of from approximately 0.93 to approximately 1.00.

The above-described novel image forming apparatus may be configured to use as the toner, toner having a spindle outer shape, and a ratio of a major axis r1 to a minor axis r2 from approximately 0.5 to approximately 1.0 and a ratio of a thickness r3 to the minor axis r2 from approximately 0.7 to approximately 1.0, where r1≧r2≧r3.

The above-described novel image forming apparatus may be configured to use as the toner, toner obtained from at least one of an elongation and a crosslinking reaction of toner composition comprising a polyester prepolymer having a function group including nitrogen atom, a polyester, a colorant, and a releasing agent in an aqueous medium under resin fine particles.

The present invention further provides a novel method of forming an image including charging a surface of an image bearing member, forming an electrostatic latent image on the surface of the image bearing member based on image data, developing the electrostatic latent image formed on the surface of the image bearing member into a toner image with toner, transferring the toner image from the image bearing member to an image receiver, removing a residual toner on the surface of the image bearing member after the toner image is transferred to the image receiver with a cleaning blade disposed in contact with the image bearing member and having a JIS-A hardness equal to or more than 70 and a repulsion elasticity equal to or less than 30%, and applying a lubricant on the surface of the image bearing member.

The applying includes rotating a brush member in a same direction as the image bearing member at the contact position with the image bearing member.

The present invention further provides a novel cleaning mechanism including a cleaning blade and a friction reducing member. The cleaning blade is configured to scrape a residual toner on a surface of an image bearing member after a toner image is transferred to an image receiver. The cleaning blade is disposed in contact with the image bearing member and has a JIS-A hardness equal to or more than 70 and a repulsion elasticity equal to or less than 30%. The friction reducing member is configured to reduce a coefficient of friction on the surface of the image bearing member.

The present invention still further provides a novel process cartridge detachably attached to an image forming apparatus. The novel process cartridge includes at least an image bearing member and a cleaning mechanism. The image bearing member is configured to bear an image on a surface thereof. The cleaning mechanism includes a cleaning blade and a friction reducing member. The cleaning blade is configured to scrape a residual toner on the surface of the image bearing member after the image is transferred to an image receiver. The cleaning blade is disposed in contact with the image bearing member and has a JIS-A hardness equal to or more than 70 and a repulsion elasticity equal to or less than 30%. The friction reducing member is configured to reduce a coefficient of friction on the surface of the image bearing member.

The present invention still further provides a novel toner including binder resin and colorant. The novel toner has a volume-based average particle diameter equal to or less than 10 μm and a distribution from approximately 1.00 to approximately 1.40, wherein the distribution is defined by a ratio of the volume-based average particle diameter to a number-based average diameter.

BRIEF DESCRIPTION OF THE DRAWINGS

A more complete appreciation of embodiments of the invention and many of the attendant advantages thereof will be readily obtained as the same becomes better understood by reference to the following description when considered in connection with the accompanying drawings, wherein.

DESCRIPTION OF THE PREFERRED EMBODIMENTS

Figure 1:
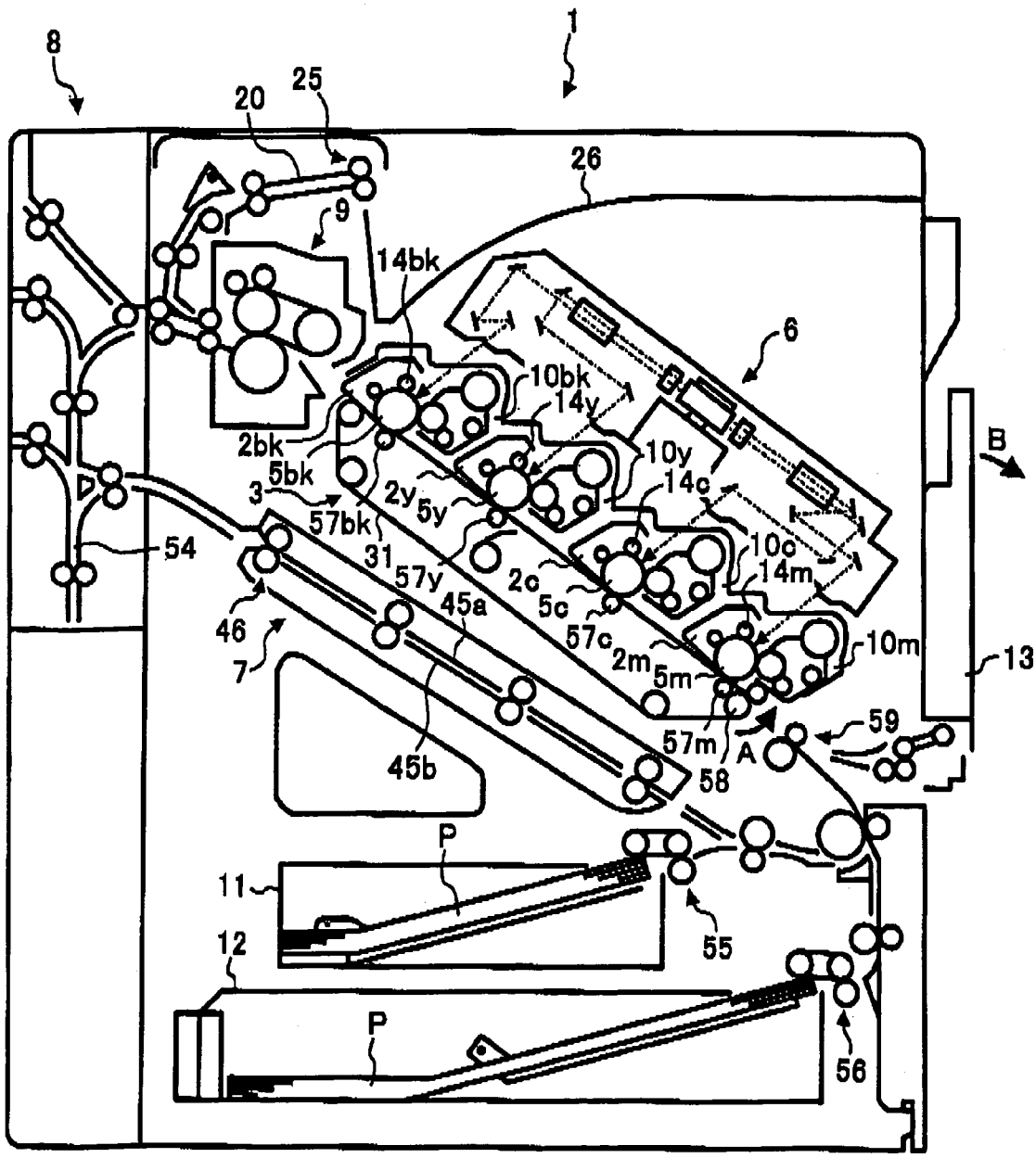
FIG. 1 is a schematic structure of a printer as an electrophotographic image forming apparatus according to an exemplary embodiment of the present invention.

In describing preferred embodiments illustrated in the drawings, specific terminology is employed for the purpose of clarity. However, the disclosure of this patent specification is not limited to the specific terminology so selected in any way and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, a printer 1 is shown as one example of an electrophotographic image forming apparatus according to an embodiment of the present invention. Although the printer 1 of FIG. 1 is configured to form a color image with toners of four different colors, such as magenta (m), cyan (c), yellow (y), and black (bk), the image forming apparatus can also be a monochromatic printer, a copier, a facsimile machine, or any other image forming apparatus.

The printer 1 can include four image forming units 2*m*, 2*c*, 2*y*, and 2*bk* as an image forming mechanism, an image transfer unit 3 as a transfer mechanism, a writing unit 6 as a writing mechanism, a fixing unit 9 as a fixing mechanism, a toner replenishing unit (not shown) as a toner feeding mechanism, and sheet feeding cassettes 11 and 12 as a sheet feeding mechanism.

The four image forming units 2*m*, 2*c*, 2*y*, and 2*bk* include four photoconductive elements 5*m*, 5*c*, 5*y*, and 5*bk*, respectively, four charging units 14*m*, 14*c*, 14*y*, and 14*bk*, respectively, and four developing units 10*m*, 10*c*, 10*y*, and 10*bk*. The four image forming units 2*m*, 2*c*, 2*y*, and 2*bk* can have similar structures and functions, except that the toners are different colors to form magenta images, cyan images, yellow images, and black images, respectively.

The four image forming units 2*m*, 2*c*, 2*y*, and 2*bk* are separately arranged at positions having different heights or elevations, in a stepped manner, and are separately detachable from the printer 1.

The photoconductive elements 5*m*, 5*c*, 5*y*, and 5*bk* separately receive respective light laser beams emitted by the writing unit 6, such that electrostatic latent images are formed on the surfaces of the four photoconductive elements 5*m*, 5*c*, 5*y*, and 5*bk*.

The charging units 14*m*, 14*c*, 14*y*, and 14*bk* include respective charging rollers (see a charging roller 141 in FIG. 2) held in contact with the photoconductive elements 5*m*, 5*c*, 5*y*, and 5*bk* to charge respective surfaces of the photoconductive elements 5*m*, 5*c*, 5*y*, and 5*bk*.

The developing units 10*m*, 10*c*, 10*y*, and 10*bk* are separately disposed in a vicinity of or adjacent to the image forming units 2*m*, 2*c*, 2*y*, and 2*bk*, respectively. The developing units 10*m*, 10*c*, 10*y*, and 10*bk* store the different colored toners for the respective image forming units 2*m*, 2*c*, 2*y*, and 2*bk*.

In this embodiment, the developing units 10*m*, 10*c*, 10*y*, and 10*bk* can have structures and functions similar to one another, and respectively contain a two-component type developer including a toner and a carrier mixture. More specifically, the developing units 10*m*, 10*c*, 10*y*, and 10*bk* respectively use magenta toner, cyan toner, yellow toner, and black toner.

Each of the developing units 10*m*, 1*c*, 10*y*, and 10*bk* includes a developing roller (not shown) facing the respective photoconductive elements 5*m*, 5*c*, 5*y*, and 5*bk*, a screw conveyor (not shown) for conveying the developer while agitating the developer, and a toner content sensor (not shown).

The developing roller includes a rotatable sleeve and a stationary magnet roller disposed in the rotatable sleeve.

The transfer unit 3 including an image transfer belt 31 is located or disposed below the image forming units 2*m*, 2*c*, 2*y*, and 2*bk* (substantially at the center of the printer 1). The image transfer belt 31 is passed over or surrounds a plurality of rollers including a paper attracting roller 58. The image transfer belt 31 is held in contact with the photoconductive elements 5*m*, 5*c*, 5*y*, and 5*bk* and travels in a same direction as that in which the photoconductive elements 5*m*, 5*c*, 5*y*, and 5*bk* rotate, as indicated by arrow A in FIG. 1.

Four primary transfer mechanisms 57*m*, 57*c*, 57*y*, and 57*bk* are disposed inside a loop of the image transfer belt 31 to face the respective photoconductive elements 5*m*, 5*c*, 5*y*, and 5*bk*, which are accommodated in the image forming units 2*m*, 2*c*, 2*y*, and 2*bk*.

The toner replenishing unit replenishes fresh toner to each of the developing units 10*m*, 10*c*, 10*y*, and 10*bk* in accordance with an output of the toner content sensor.

Carrier particles generally include a core material or the core material provided with a coating layer. Magnetic material such as ferrite and magnetite may be used as the core material of the resin-coated carrier particles. A particle size of the core material may preferably be approximately 20 μm to approximately 65 μm, and more preferably be approximately 30 μm to approximately 60 μm. The material for forming a carrier coating layer may be any one of styrene resins, acrylic resins, fluorine contained resins, silicone resins, and mixtures or copolymers of the above-described resins. The carrier coating layer may be formed by spraying the resin on the surfaces of the particles of the core material or by dipping the particles in the resin as used in a conventional method.

The writing unit 6 is provided at a position above the image forming units 2*m*, 2*c*, 2*y*, and 2*bk*. The writing unit 6 has four laser diodes (LDs), a polygon scanner, and lenses and mirrors. The four laser diodes (LDs) serve as light sources and irradiate the respective photoconductive elements 5*m*, 5*c*, 5*y*, and 5*bk* with respective imagewise laser light beams to form electrostatic latent images thereon. The polygon scanner includes a polygon mirror having six surfaces and a polygon motor. Lenses such as f-theta lenses, elongate WTLs, and other lenses, and mirrors are provided in an optical path of the respective laser light beams. The laser light beams emitted from the laser diodes are deflected by the polygon scanner to irradiate the photoconductive elements 5*m* 5*c*, 5*y*, and 5*bk*.

The sheet feeding mechanism is arranged in a lower portion of the printer 1, and includes the sheet feeding cassettes 11 and 12, sheet separation and feed units 55 and 56 assigned to the sheet feeding cassettes 11 and 12, respectively, and a pair of registration rollers 59. The sheet feeding cassettes 11 and 12 are loaded with a stack of sheets of particular size including a recording paper P. When an image forming operation is performed, the recording paper P is fed from one of the sheet feeding cassettes 11 and 12 and is conveyed toward the pair of registration rollers 59.

The sheet feeding mechanism also includes a duplex print unit 7, a reverse unit 8, a manual sheet feeding tray 13, a reverse discharging path 20, a sheet discharging roller pair 25, and a discharging tray 26.

The duplex print unit 7 is provided at a position below the image transfer belt 31. In addition, the reverse unit 8 is provided on a left side of the printer 1 of FIG. 1, which discharges a recording paper P on which an image is formed after reversing the recording paper P or feeds the recording paper P to the duplex print unit 7.

The duplex print unit 7 includes a pair of guide plates 45*a* and 45*b*, and four pairs of sheet feeding rollers 46. When a duplex image forming operation is performed, the duplex print unit 7 receives the recording paper P on one side of which an image is formed and which is fed to the duplex print unit 7 after the recording paper P is switched back at a reverse transporting passage 54 of the reverse unit 8. The duplex print unit 7 then transports the recording paper P to the sheet feeding mechanism.

The reverse unit 8 includes plural pairs of feeding rollers and plural pairs of feeding guides of the reverse transporting passage 54. As described above, the reverse unit 8 feeds the recording paper P on which an image is formed to the duplex print unit 7 after reversing the recording paper P or discharges the recording paper P without reversing the recording paper P.

The manual sheet feeding tray 13 is mounted on the right side of the printer 1 of FIG. 1. The manual sheet feeding tray 13 is openable in a direction indicated by arrow B. After opening the manual sheet feeding tray 13, an operator of the printer 1 may feed sheets by hand.

The fixing unit 9 serving as the fixing mechanism is positioned between the image transfer belt 31 and the reverse unit 8 for fixing an image formed on the recording paper P. The reverse discharge path 20 branches off a downstream side of the fixing unit 9 in the direction in which the recording paper P is conveyed, so that the recording paper P conveyed into the reverse discharge path 20 is driven out to the discharging tray 26 by a sheet discharging roller pair 25.

A full-color image forming operation of the printer 1 is now described.

When the printer 1 receives full color image data, each of the photoconductive elements 5*m*, 5*c*, 5*y*, and 5*bk* rotates in a clockwise direction in FIG. 1 and is uniformly charged with the corresponding charging rollers 14*m*, 14*c*, 14*y*, and 14*bk*. The writing unit 6 irradiates the photoconductive elements 5*m*, 5*c*, 5*y*, and 5*bk* of the image forming units 2*m*, 2*c*, 2*y*, and 2*bk* with the laser light beams corresponding to the respective color image data, resulting in formation of electrostatic latent images, which correspond to the respective color image data, on respective surfaces of the photoconductive elements 5*m*, 5*c*, 5*y*, and 5*bk*. The electrostatic latent images formed on the respective photoconductive elements 5*m*, 5*c*, 5*y*, and 5*bk* are developed with the respective developers including respective color toners at the respective developing units 10*m*, 10*c*, 10*y*, and 10*bk*, resulting in formation of magenta, cyan, yellow, and black toner images on the respective photoconductive elements 5*m*, 5*c*, 5*y*, and 5*bk*.

The recording paper P is fed from one of the sheet feeding cassettes 11 and 12 with the respective sheet separation and feed units 55 and 56. The recording paper P is fed to the image forming units 2*m*, 2*c*, 2*y*, and 2*bk* in synchronization with the pair of registration rollers 59 so that the color toner images formed on the photoconductive elements 5*m*, 5*c*, 5*y*, and 5*bk* are transferred onto a proper position of the recording paper P.

The recording paper P is positively charged with the paper attracting roller 58, and thereby the recording paper P is electrostatically attracted by the surface of the image transfer belt 31. The recording paper P is fed while the recording paper P is attracted by the image transfer belt 31, and the magenta, cyan, yellow, and black toner images are sequentially transferred onto the recording paper P, resulting in formation of a full color image in which the magenta, cyan, yellow, and black toner images are overlaid.

The full color toner image on the recording paper P is fixed by the fixing unit 9 through the application of heat and pressure. The recording paper P having the fixed full color image is fed through a predetermined passage depending on image forming instructions. Specifically, the recording paper P is discharged to the sheet discharging tray 26 with an image side facing downward, or is discharged from the fixing unit 9 after passing through the reverse unit 8. Alternatively, when a duplex image forming operation is specified, the recording paper P is fed to the reverse transporting passage 54 and is switched back to be fed to the duplex print unit 7. Then another image is formed on the other side of the recording paper P by the image forming units 2*m*, 2*c*, 2*y*, and 2*bk*, and a duplex print copy having color images on both sides of the recording paper P is discharged. When a request producing two or more copies is specified, the image forming operation described above is repeated.

After the toner image is transferred to the image transfer belt 31, the photoconductive element 5 is separated from the image transfer belt 31. The photoconductive element 5 then keeps its rotation so that a brush roller can apply lubricant scraped from a molded lubricant onto the surface of the photoconductive element 5. Details of the lubricant and the related units will be described later.

The subsequent image forming operations will repeat the above-described image forming processes. Since the layer of the lubricant on the surface of the photoconductive element 5 is thinly formed, the layer may not degrade the charging efficiency by the charging unit 14. A toner image newly formed on the photoconductive element 5 may be transferred onto a transfer sheet conveyed by the image transfer belt 31 in a next image forming operation of the printer 1.

Figure 2:
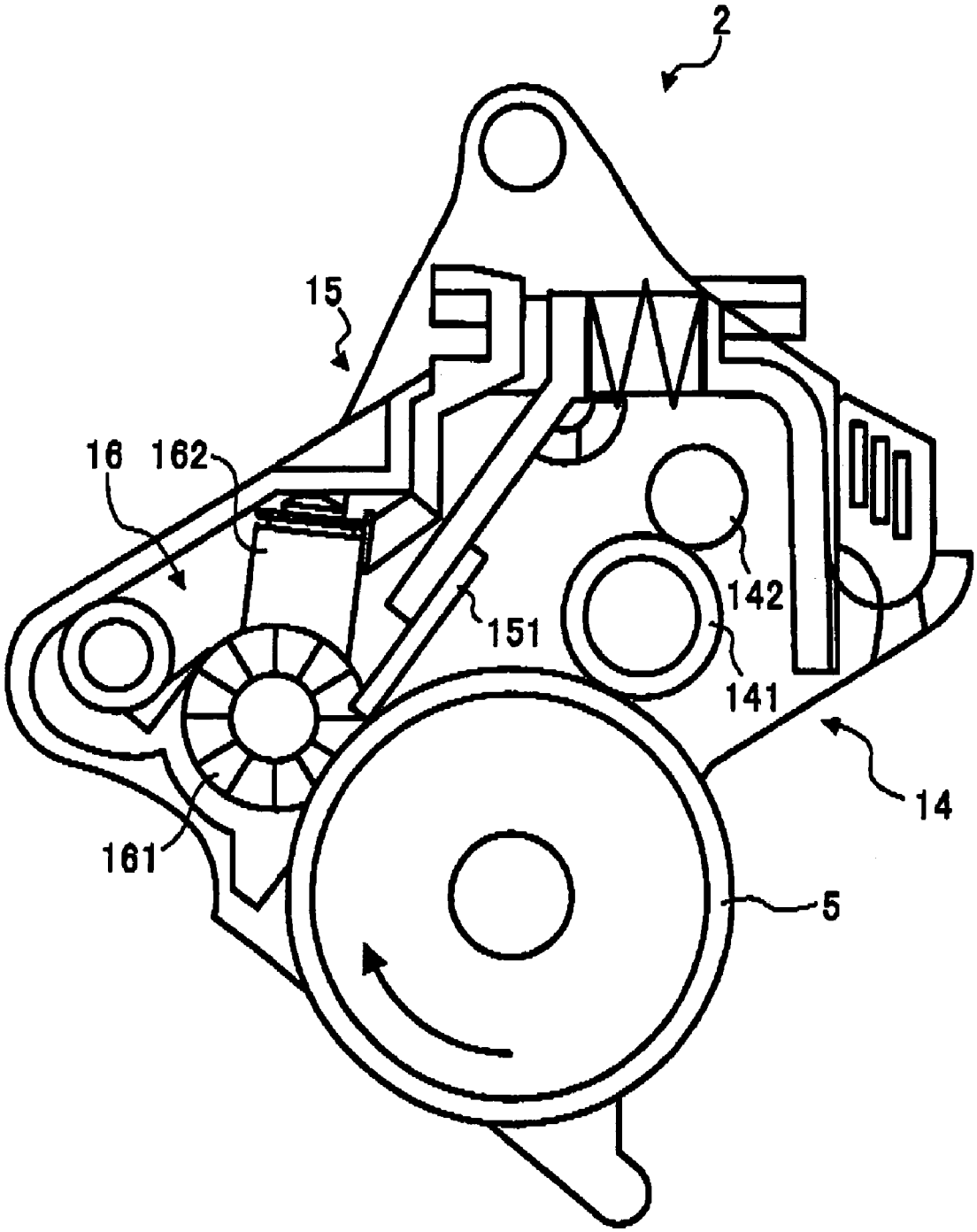
FIG. 2 is a schematic structure of an image forming unit and peripheral components for image forming of the printer of FIG. 1.

Referring to FIG. 2, a structure of one of the image forming units 2*m*, 2*c*, 2*y*, and 2*bk* is described. Each of the image forming units 2*m*, 2*c*, 2*y*, and 2*bk* has respective components around it. Since the image forming units 2*m*, 2*c*, 2*y*, and 2*bk* have similar structures and functions to each other, except that the toners contained therein are of different colors, the discussion below with respect to FIGS. 2 and 3 uses reference numerals for specifying components of the full-color printer 1 without suffixes indicative of colors such as m, c, y, and bk. In other words, the image forming unit 2 of FIG. 2, for example, can be any one of the image forming units 2*m*, 2*c*, 2*y*, and 2*bk*.

As shown in FIG. 2, the image forming unit 2 includes the photoconductive element 5, the charging unit 14, a cleaning unit 15, and a lubricating unit 16.

The photoconductive element 5 can include an amorphous photoconductive metal (e.g., amorphous silicone, amorphous selenium, etc.) and an organic compound (e.g., bisazo pigments, phthalocyanine pigments, etc.) In light of environmental factors and disposal after use, it is preferable to use an OPC (organic photo conductor) element having an organic compound.

The charging unit 14 may employ any one of a corona charging method, a roller charging method, a brush charging method, and a blade charging method. The charging unit 14 in this embodiment employs a roller charging method. The charging unit 14 includes a charging roller 141, a charging roller cleaning brush 142, and a power supply (not shown). The charging roller cleaning brush 142 is held in contact with the charging roller 14 for the purpose of cleaning. The power supply is connected with the charging roller 141. A high voltage is applied to the charging roller 141 to apply a predetermined voltage between the photoconductive element 5 and the charging roller 141. Then, corona discharge is generated between the photoconductive element 5 and the charging roller 141, thereby uniformly charging a surface of the photoconductive element 5.

The cleaning unit 15 includes a cleaning blade 151, a lubricant supplying unit 16, and a molded lubricant 162.

The cleaning blade 151 is held in contact with the photoconductive element 5.

The cleaning blade 151 may include liquid thermosetting materials such as urethane rubber. The cleaning blade 151 may be urethane rubber, but it is not limited to this material.

The cleaning blade 151 can be prepared, in particular, by a method selected from one-shot methods, prepolymer methods, and pseudo one-shot methods that stand between the one-shot methods and prepolymer methods.

Main components of suitable liquid thermosetting materials are, for example, prepolymer for urethane rubber and curing agent. The prepolymer for urethane rubber is obtained by partially polymerizing polyisocyanate and polyol.

The lubricant supplying unit 16 is arranged upstream of the cleaning blade 151 in a rotation of the photoconductive element 5. The lubricant supplying unit 16 abrasively scrapes the molded lubricant 162 to apply the scraped lubricant to the photoconductive element 5. The lubricant supplying unit 16 also includes a function as a toner removing unit. After a primary transfer operation, the lubricant supplying unit 16 serving as the toner removing unit removes toner remaining on the surface of the photoconductive element 5. Subsequently, the lubricant supplying unit 16 supplies small particles of lubricant scraped from the molded lubricant 162, so that the toner remaining on the surface of the photoconductive element 5 is finally removed by the cleaning blade 151 to prevent problems such as a toner filming.

Since the lubricant supplying unit 16 has both a function of a lubricating unit and that of a toner removing unit, the structure of the cleaning unit 15 can be made simpler than before.

The lubricant supplying unit 16 serving as the toner removing unit may include a brush roller 161 as shown in FIG. 2. The brush roller 161 includes resins such as nylon resins, acrylic resins, etc. added by a resistivity control material such as carbon black, and is controlled to have a volume resistivity in a range of from approximately $1\times10^3$ Ωcm to approximately $1\times10^8$ Ωcm. The brush roller 161 is arranged in a vicinity of the molded lubricant 162 as the molded lubricant 162 contacts by a spring with the brush roller 161.

Specific examples of the molded lubricant 162 are metal salts of fatty acids such as lead oleate, zinc oleate, copper oleate, zinc stearate, cobalt stearate, iron stearate, copper stearate, zinc palmitate, copper palmitate, and zinc linoleate. Among the metal salts of fatty acids, zinc stearate is preferable.

Alternatively, the metal salts of fatty acids such as zinc stearate and calcium stearate may be powdered to be rubbed in a solid mold as a molded lubricant.

The brush roller 161 rotatably scrapes the molded lubricant 162 to supply fine lubricant particles onto the surface of the photoconductive element 5. When the cleaning blade 151 contacts the photoconductive element 5, the fine lubricant particles are spread to form a thin film layer so that a friction coefficient of the surface of the photoconductive element 5 may be reduced. The rotation direction of the brush roller 161 may be the same as that of the photoconductive element 5 at a position in which the brush roller 161 contacts the photoconductive element 5. That is, the cleaning blade 151 is disposed downstream of a contact position of the brush roller 161 and the photoconductive element 5 in a rotation direction of the photoconductive element 5.

Alternatively, the powdered zinc stearate, calcium stearate, etc. may be directly applied onto the surface of the photoconductive element 5 by a powder supplying mechanism (not shown).

When a modulus of repulsion elasticity of the cleaning blade 151 for scraping toner remaining on the surface of the photoconductive element 5 is equal to or lower than 40% in a range of from 10° C. to 40° C., the cleaning blade 151 may reduce squeaking and chattering sounds and the photoconductive element 5 may be prevented from abrasion. It is because the modulus of repulsion elasticity of the cleaning blade 151 is low, self-induced vibration such as stick slip may less occur at a contact point of the cleaning blade 151 and the photoconductive element 5, resulting in less abrasion of the surface of the photoconductive element 5.

Further, the cleanability may increase when the cleaning blade 151 is bent by five degree and when a modulus of flexural rigidity of the cleaning blade 151 obtained at a point that is 5 mm away from a fulcrum of the cleaning blade 151 is equal to or greater than 400 mN. If the modulus of flexural rigidity of the cleaning blade 151 is less than 400 mN, a linear pressure applied to a portion in which the cleaning blade 151 contacts the photoconductive element 5 may become lower, and a force to prevent the toner from falling through the space between the cleaning blade 151 and the photoconductive element 5 may become weaker.

When the cleaning blade 151 has a low degree of hardness determined based on JIS-A (Japanese Industrial Standards, Division A), the cleaning blade 151 held in contact with the photoconductive element 5 may easily be deformed. If the area the cleaning blade 151 contacts the photoconductive element 5 is increased, a contact pressure to the area may be decreased, resulting in an increase of toner passing through the space between the cleaning blade 151 and the photoconductive element 5. Further, when the toner is pushed to the edge of the cleaning blade 151, the cleaning blade 151 cannot apply a sufficient power to push back the toner, resulting in an increase of toner passing through the above-described space.

The cleaning blade 151 of the present invention can stop the toner falling through the space between the cleaning blade 151 and the photoconductive element 5.

Figure 3:
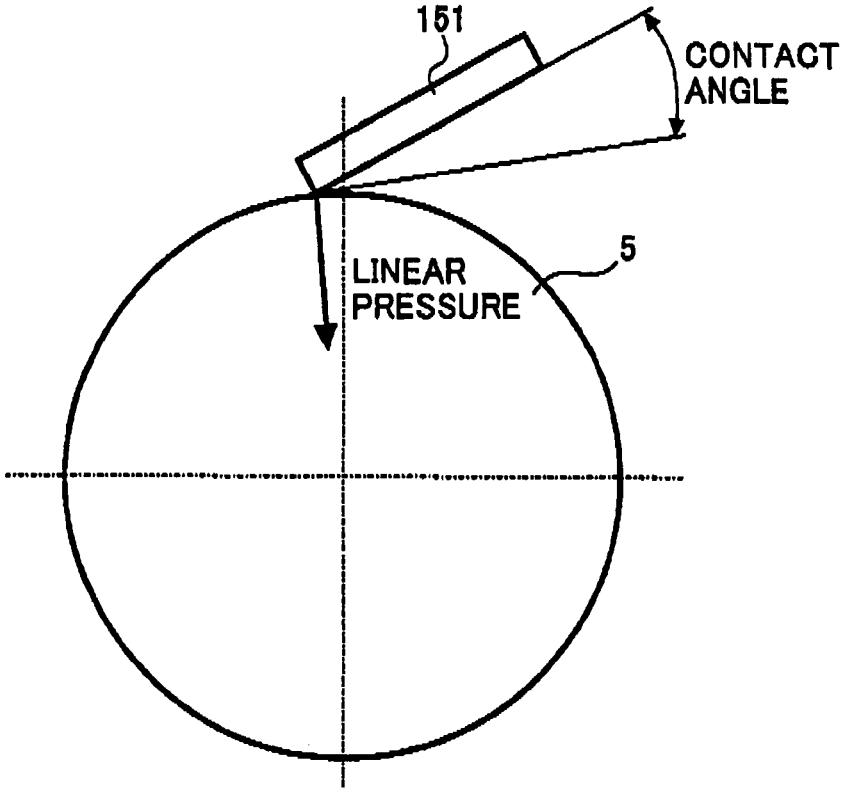
FIG. 3 is a schematic structure of a linear pressure of a cleaning blade applied to a photoconductive element provided in the image forming unit of FIG. 2 and a contact angle formed between the cleaning blade and the photoconductive element.
Figure 4:
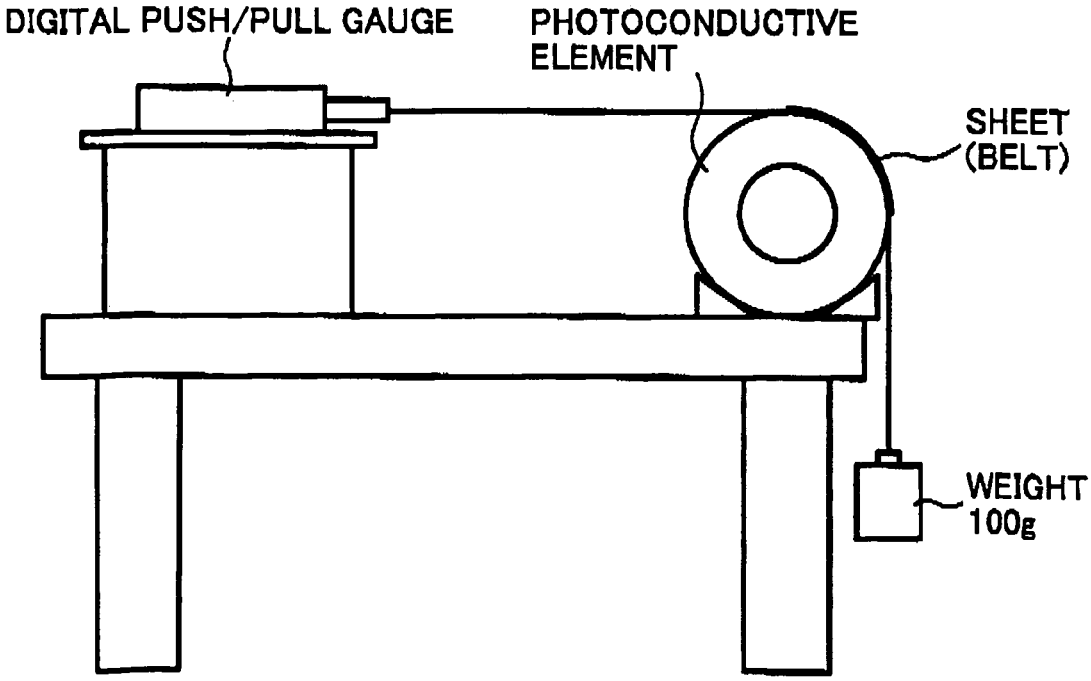
FIG. 4 is a side elevation view showing measurement of a friction coefficient of the photoconductive element of the printer 1.

Referring to FIGS. 3 and 4 and Table 1, a measurement for optimal hardness and repulsion elasticity of the cleaning blade 151 is described.

The cleaning blade 151 is held in contact with the photoconductive element 5 having a low coefficient of friction due to its lubricated surface, and is required to have optimal degrees of hardness and repulsion elasticity of the cleaning blade 151 with respect to the photoconductive element 5 to obtain a good cleanability and to stabilize a position of the cleaning blade 151. In light of the circumstances, the measurements was held to find out the optical degrees of hardness and repulsion elasticity of the cleaning blade 151.

FIG. 3 shows a schematic structure of the cleaning blade 151 contacting the photoconductive element 5. In this measurement, a linear pressure of the cleaning blade 151 against the photoconductive element 5 is 25 g/cm, and an initial contact angle thereof is 17 degrees. An amount of depth of the cleaning blade 151 digging into the surface of the photoconductive element 5 is 1.0 mm.

The coefficient of static friction of the photoconductive element 5 is determined to be 0.25 according to a measurement by Euler's method as described below in reference to FIG. 4.

FIG. 4 is a side elevation view showing measurement of the coefficient of static friction of the photoconductive element 5. In this case, a good quality paper of medium thickness is stretched as a belt over one fourth of a circumference of the photoconductive element 5 longitudinally in the direction of pulling. Both ends in a pulling direction of the good quality paper are provided with strings as a member supporting the paper. A weight of 0.98 N (100 gram) is suspended from one side of the belt. A force gauge installed on the other end is pulled. And, a load when the belt is moved is read out to be substituted in a following relation: $\mu s=2/\pi\times 1n$ in (F/0.98), where "μs" is a coefficient of static friction, and where "F" is a measured value. The friction coefficient of the photoconductive element 5 of the printer 1 serving as an image forming apparatus is set to a value that is set when the rotation becomes stable due to the image forming. Since the friction coefficient of the photoconductive element 5 is affected by other units arranged in the printer 1, the value is variable depending on a friction coefficient obtained immediately after the image forming is completed. However, the value of the friction coefficient may substantially become stable after 1000 of A4-size recording sheets are printed. Therefore, a friction coefficient described here is determined to be a friction coefficient obtained in a stable condition.

Table 1 shows measurement results evaluating abrasions of nine cleaning blades A through I. The nine cleaning blades have different degrees of hardness by JIS-A (Japanese Industrial Standards, Division A) and different modulus of repulsion elasticity. Abrasions of the nine cleaning blades A through I were evaluated after performing respective printing operations of producing 10,000 copies each with the nine cleaning blades A through I. In the column of "Evaluation" in Table 1, "Good" represents the abrasion amount of the corresponding cleaning blade is less than 4 μm, "Acceptable" represents the abrasion amount of the corresponding cleaning blade is equal to or greater than 4 μm and less than 7 μm, and "Poor" represents the abrasion amount of the corresponding cleaning blade is equal to or greater than 7 μm.

TABLE 1

| Cleaning blade | Hardness (degree) | Repulsion elasticity (%) | 100% modulus (MPa) | 300% modulus (MPa) | Abrasion (μm) | Evaluation |
|---|---|---|---|---|---|---|
| A | 75 | 16 | 4.4 | — | 1 | Good |
| B | 72 | 15 | 4.4 | — | 1 | Good |
| C | 70 | 17 | 3.6 | — | 2 | Good |
| D | 72 | 17 | 2.8 | 37 | 4 | Acceptable |
| E | 70 | 50 | 3.1 | 11 | 8 | Poor |
| F | 75 | 45 | 3.9 | 15 | 7 | Poor |
| G | 70 | 37 | 5.5 | 40 | 5 | Acceptable |
| H | 78 | 49 | 5.1 | 13 | 12 | Poor |
| I | 72 | 29 | 3.2 | 21 | 5 | Acceptable |

According to the measurement results of Table 1, when the cleaning blade 151 has a degree of hardness equal to or greater than 70 by JIS-A and a degree of repulsion elasticity equal to or less than 30%, the cleaning blade 151 can stably stop the toner from falling through the space between the cleaning blade 151 and the photoconductive element 5, thereby increasing the removability of toner. Further, in this measurement, the cleaning blade 151 has an elongation at break equal to or greater than 20 MPa of 300% modulus or equal to or greater than 200% modulus.

In this embodiment, the photoconductive element 5 and the cleaning unit 15 may be integrally assembled in a process cartridge. Alternatively, the charging unit 14 and/or the developing unit 10 may be additionally integrally assembled in the process cartridge. The process cartridge may be detachably attached to the printer 1 for easy maintenance. The process cartridge may be replaced with a new one at the end of its useful life.

With the process cartridge, small toner particles having a substantially spherical shape may be effectively removed from the photoconductive element 5 in the image forming process, thereby preventing deterioration in image quality.

Further, the process cartridge is useful for easy maintenance. In a case in which the printer 1 has a problem due to at least one of the photoconductive element 5, the cleaning unit 15, and the charging unit 14, and/or the developing unit 10, a replacement of the process cartridge can restore the printer 1 to its original state easily, thereby reducing a period of time for servicing.

Further, a good removability of toner particles on the photoconductive element 5 may highly contribute to a long life time of the process cartridge.

The cleaning unit 15 of the present invention may be effectively used for the printer 1 when the toner used in the developing unit 10 has high circularity, that is, the toner particles has an average circularity equal to or more than 0.93.

Accordingly, with the cleaning unit 15 of the present invention, the toner particles having a substantially spherical shape may be effectively removed from the photoconductive element 5. That is, the toner particles remaining on the surface of the photoconductive element 5 are first removed by the brush roller 161. The brush roller 161 then applies the molded lubricant 162 to the surface of the photoconductive element 5 so that the coefficient of friction of the photoconductive element 5 may be reduced. After the brush roller 161, the cleaning blade 151 scrapes the remaining toner to be removed from the surface of the photoconductive element 5. Thus, even the small toner particles having a substantially spherical shape can be effectively removed without causing any damage to the surface of the photoconductive element 5.

The cleaning unit 15 is preferable to clean particles of toner having a substantially spherical shape. It is preferable that a shape factor SF1 of the toner is in a range from approximately 100 to approximately 180, and the shape factor SF2 of the toner is in a range from approximately 100 to approximately 180.

Figure 5A:
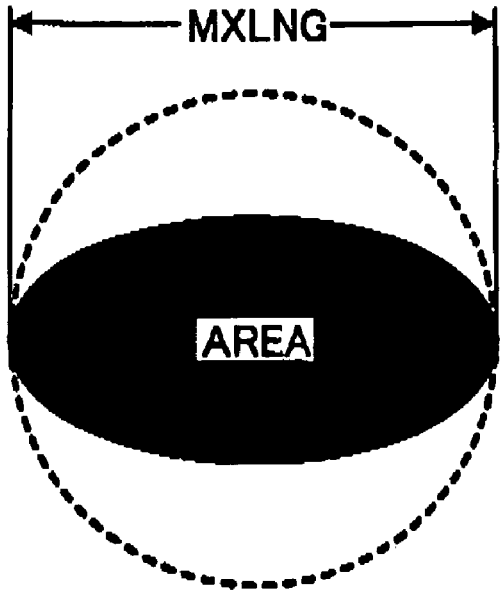
FIG. 5A is a drawing of a toner having an "SF1" shape factor and FIG. 5B is a drawing of a toner having an "SF2" shape factor.
Figure 5B:
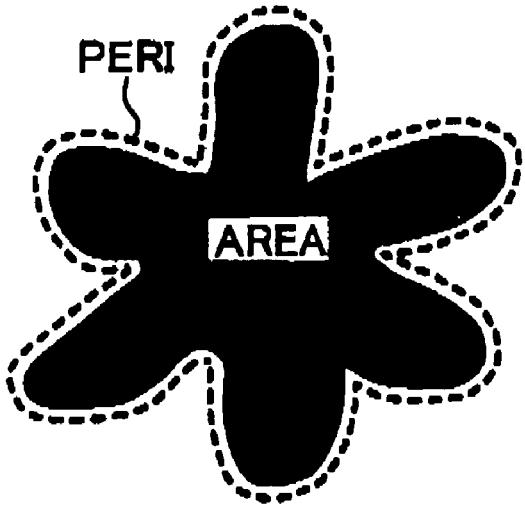

Referring to FIG. 5A, the shape factor SF1 is a parameter representing the roundness of a particle in FIG. 5A, and the shape factor SF2 is a parameter representing the roundness of a particle in FIG. 5B.

The shape factor SF1 of a particle is calculated by the following equation:

$$SF1=\{(MXLNG)^2/\text{AREA}\}\times(100\pi/4) \quad \text{Equation 1,}$$

where MXLNG represents the maximum major axis of an elliptical-shaped figure obtained by projecting a toner particle on a two dimensional plane, and AREA represents the projected area of elliptical-shaped figure.

When the value of the shape factor SF1 is 100, the particle has a perfect spherical shape. As the value of SF1 increases, the shape of the particle becomes more elliptical.

Referring to FIG. 5B, the shape factor SF2 is a value representing irregularity (i.e., a ratio of convex and concave portions) of the shape of the material. The shape factor SF2 of a particle is calculated by the following equation:

$$SF2=\{(PERI)^2/\text{AREA}\}\times(100/4\pi)$$

where PERI represents the perimeter of a figure obtained by projecting a toner particle on a two dimensional plane.

When the value of the shape factor SF2 is 100, the surface of the material is even (i.e., no convex and concave portions). As the value of the SF2 increases, the surface of the material becomes uneven (i.e., the number of convex and concave portions increase).

In this embodiment, toner images are sampled using a field emission type scanning electron microscope (FE-SEM) S-800 manufactured by Hitachi, Ltd. The toner image information is analyzed using an image analyzer (LUSEX3) manufactured by Nireko, Ltd.

As the toner shape becomes spherical, a toner particle becomes held in point-contact with another toner particle or the photoconductive element 5. Under the above-described condition, the toner adhesion force between two toner particles may decrease, resulting in the increase in toner fluidity, and the toner adhesion force between the toner particle and the photoconductive element 5 may decrease, resulting in the increase in toner transferability. And, as described above, while a cleaning unit with a cleaning blade may have poor toner removing performance in removing toner particles having a spherical shape, the cleaning unit 15 according to the present invention may easily remove the toner particles remaining on the surface of the photoconductive element 5.

Further, considering cleaning performance, it is preferable that the values of the shape factors SF1 and SF2 exceed 100. As the values of the shape factors SF1 and SF2 become greater, the toner charge distribution becomes greater and a load to the temporary toner storing mechanism becomes greater. Therefore, the values of the shape factors SF1 and SF2 are preferably less than 180.

Further, the toner used in the image forming apparatus has a volume average particle size in a range from approximately 3 μm to approximately 8 μm. The particles of the toner are small in size and are in a range from approximately 1.00 to approximately 1.40 of ratio (Dv/Dn) of the volume average particle size (Dv) and the number average particle size (Dn) and the particle size distribution is narrow. By narrowing the particle size distribution, the charging distribution of the toner becomes uniform and it is possible to achieve a high quality image with less excessive concentration of toner at a particular point on the paper and to have a higher transferring rate. It has been difficult to clean such toner having a small particle size with blade cleaning and overcoming the adhesive power of the toner on the photoconductive element. When the toner has such a small particle size, the contents of fine particles of additives, etc. of the toner may be relatively high, these fine particles may be separated from the toner particles, easily causing toner filming on the surface of the photoconductive element 5.

However, by installing the cleaning unit 15 of the present invention, the brush roller 161 applies a lubricant to the surface of the photoconductive element 5 to reduce the friction coefficient of the surface of the photoconductive element 5, the cleaning blade 151 blocks the toner from passing through a gap between the photoconductive element 5 and the cleaning blade 151, thereby the toner removing performance may be more effective.

A toner having a substantially spherical shape is preferably prepared by a method in which a toner composition dissolved or dispersed in an organic solvent, including a polyester prepolymer having a function group including a nitrogen atom, a polyester, a colorant, and a releasing agent is subjected to an elongation reaction and/or a crosslinking reaction in an aqueous medium in the presence of fine resin particles.

Toner constituents and preferable manufacturing method of the toner of the present invention will be described below.

(Polyester)

The toner of the present invention includes a modified polyester (i) as binder resins.

The toner in the present invention includes modified polyester (i) as a binder resin. Modified polyester means a polyester in which there is a bonding group present other than an ester bond in the polyester resin and resinous principles having a different structure in the polyester resin are bonded by a bond like covalent bond and ion bond. Concretely, it means a polyester terminal that is modified by introducing a functional group like an isocyanate group that reacts with a carboxylic acid group, a hydroxyl group to a polyester terminal and then allowed to react with a compound containing active hydrogen.

Suitable polyesters include reaction products of a polyester prepolymer (A) having an isocyanate group with an amine (B). The polyester prepolymer (A) can be formed from a reaction between a polyester having an active hydrogen atom, which polyester is formed by polycondensation between a polyol (PO) and a polycarboxylic acid (PC), and a polyisocyanate (PIC). Specific examples of the groups including the active hydrogen include a hydroxyl group (an alcoholic hydroxyl group and a phenolic hydroxyl group), an amino group, a carboxyl group, a mercapto group, etc. In particular, the alcoholic hydroxyl group is preferably used.

As the polyol (PO), diols (DIo) and polyols having 3 or more valences (TO) can be used. In particular, a diol (DIO) alone or a mixture of a diol (DIO) and a small amount of polyol having 3 or more valences (TO) is preferably used. Specific examples of the diol (DIO) include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, alkylene glycol having 2 to 12 carbon atoms and adducts of bisphenol with an alkylene oxide are preferably used, and a mixture thereof is more preferably used. Specific examples of the polyol having 3 valences or more valences (TO) include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarboxylic acid (PC), dicarboxylic acid (DIC) and polycarboxylic acids having 3 or more valences (TC) can be used. A dicarboylic acid (DIC) alone, or a mixture of the dicarboxylic acid (DIC) and a small amount of polycarboxylic acid having 3 or more valences (TC) is preferably used. Specific examples of the dicarboxylic acids (DIC) include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the polycarboxylic acid having 3 or more valences (TC) include aromatic polycarboxylic acids having 9 to 20 carbon atoms such as trimellitic acid and pyromellitic acid. The polycarboxylic acid (PC) can be formed from a reaction between the above-mentioned acids anhydride or lower alkyl ester such as methyl ester, ethyl ester and isopropyl ester.

The polyol (PO) and the polycarboxylic acid (PC) are mixed such that the equivalent ratio ([OH]/[COOH]) between the hydroxyl group [OH] of the polyol (1) and the carboxylic group [COOH] of the polyol carboxylic acid (2) is typically from 2/1 to 1/1, preferably from 1.5/1 to 1/1 and more preferably from 1.3/1 to 1.02/1.

Specific examples of the polyisocyanate (PIC) include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; 10 aromatic diisocyanate such as tolylenedisocyanate and diphenylmethanediisocyanate; aroma aliphatic diisocyanate such as .alpha., .alpha., .alpha.', .alpha.'-te-tramethylxylylenediisocyanate; isocyanurate; the above-mentioned polyisocyanate blocked with phenol derivatives, oxime and caprolactam; and their combinations.

The polyisocyanate (PIC) is mixed with a polyester such that the equivalent ratio ([NCO]/[OH]) between the isocyanate group [NCO] of the polyisocyanate (PIC) and the hydroxyl group [OH] of the polyester is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When the molar ratio of [NCO] is less than 1, the urea content in the resultant modified polyester decreases and hot offset resistance of the resultant toner deteriorates.

The content of the constitutional unit obtained from a polyisocyanate (PIC) in the polyester prepolymer (A) is from 0.5% to 40% by weight, preferably from 1% to 30% by weight and more preferably from 2% to 20% by weight. When the content is less than 0.5% by weight, hot offset resistance of the resultant toner deteriorates and in addition the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diamino cyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of amino acid (B5) are aminopropionic acid and caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, molecular weight of the urea-modified polyester decreases, resulting in deterioration of hot offset resistance of the resultant toner.

Suitable polyester resins for use in the toner of the present invention include a urea-modified polyesters (i). The urea-modified polyester (i) may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the molar ratio of the urea bonding is less than 10%, hot offset resistance of the resultant toner deteriorates.

Modified polyesters such as the urea-modified polyester (i) can be produced by a method such as one-shot methods and prepolymer methods. The weight-average molecular weight of the urea-modified polyester (i) is not less than 10,000, preferably from 20,000 to 10,000,000 and more preferably from 30,000 to 1,000,000. In addition, the peak molecular weight is preferably from 1,000 to 10,000. When the peak molecular weight is less than 1,000, an elongation reaction tends not to occur and elasticity of the toner is low, hence hot offset resistance of the resultant toner deteriorates. When the peak molecular weight is more than approximately 10,000, fixability is impaired and manufacturing problems may occur for example in the particle formation process or the pulverization process. The number-average molecular weight of the urea-modified polyester (i) is not particularly limited when the after-mentioned unmodified polyester resin (ii) is used in combination. Namely, the weight-average molecular weight of the urea-modified polyester resins has priority over the number-average molecular weight thereof. However, when the urea-modified polyester (i) is used alone, the number-average molecular weight is not greater than 20,000, preferably from 1,000 to 10,000, and more preferably from 2,000 to 8,000. When the number-average molecular weight is greater than 20,000, the low temperature fixability of the resultant toner deteriorates, and in addition the glossiness of full color images deteriorates.

A reaction anticatalyst can optionally be used in the crosslinking and/or elongation reaction between the polyester prepolymer (A) and amines (B) to control a molecular weight of the resultant urea-modified polyesters, if desired. Specific examples of the reaction anticatalyst include monoamines such as diethyl amine, dibutyl amine, butyl amine and lauryl amine, and blocked amines, i.e., ketimine compounds prepared by blocking the monoamines mentioned above.

(Unmodified Polyester)

In the present invention, not only the urea-modified polyester (i) alone but also the unmodified polyester resin (ii) can be included as a toner binder with the urea-modified polyester (i). A combination thereof improves low temperature fixability of the resultant toner and glossiness of color images produced thereby, and using the combination is more preferable than using the urea-modified polyester (i) alone.

Suitable unmodified polyester resin (ii) includes polycondensation products of a polyol (PO) and a polycarboxylic acid (PC) similarly to the urea-modified polyester (i). Specific examples of the polyol (PO) and the polycarboxylic acid (PC) are the same as those for use in the urea-modified polyester (i). Polyester resins modified by a bonding such as urethane bonding other than a urea bonding can be considered to be the unmodified polyester in the present invention. It is preferable that the urea-modified polyester (i) at least partially mixes with the unmodified polyester resin (ii) to improve the low temperature fixability and hot offset resistance of the resultant toner. Therefore, the urea-modified polyester (i) preferably has a structure similar to that of the unmodified polyester resin (ii). A mixing ratio ((i)/(ii)) between the urea-modified polyester (i) and polyester resin (ii) is from 5/95 to 80/20 by weight, preferably from 5/95 to 30/70 by weight, more preferably from 5/95 to 25/75 by weight, and even more preferably from 7/93 to 20/80 by weight. When the weight ratio of the urea-modified polyester (i) is less than 5%, the hot offset resistance deteriorates, and in addition, it is difficult to impart a good combination of high temperature preservability and low temperature fixability of the toner.

The peak molecular weight of the unmodified polyester (ii) is generally 1,000 to 10,000, preferably 2,000 to 8,000, and more preferably 2,000 to 5,000. When the peak molecular weight thereof is less than approximately 1,000, heat-resistant storability is impaired. When the peak molecular weight thereof is more than approximately 10,000, low temperature fixability is impaired. It is preferable that the hydroxyl value of (ii) is not less than 5. The value in a range of 10 to 120 is more preferable and a range of 20 to 80 is particularly preferable. The hydroxyl value thereof is less than approximately 5, it is difficult to impart a good combination of heat resistance storability and low temperature fixability. The acid value of the unmodified polyester (ii) is approximately 1 to approximately 5, and preferable 2 to 4. Since the wax having a high acid value is generally used as a wax component of the toner, it is preferable to use the resin having a low acid value as a toner binder because good charge property and high volume resistivity can be imparted to the resultant toner. Thus, the toner formed from such a wax and a resin is suitable for a two-component toner.

The toner binder preferably has a glass transition temperature (Tg) of from 35° C. to 70° C., and preferably from 55° C. to 65° C. When the glass transition temperature is less than 35° C., the high temperature preservability of the toner deteriorates. When the glass transition temperature is higher than 70° C., the low temperature fixability deteriorates. Due to a combination of the modified polyester such as urea-modified polyester and polyester resin, the toner of the present invention has better high temperature preservability than conventional toners including a polyester resin as a binder resin even though the glass transition temperature is low.

(Colorant)

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, 25 Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol-Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

A content of the colorant in the toner is preferably from 1% by weight to 15% by weight, and more preferably from 3% by weight to 10% by weight, based on total weight of the toner.

The colorants mentioned above for use in the present invention can be used as master batch pigments by being combined with a resin.

The examples of binder resins to be kneaded with the master batch or used in the preparation of the master batch are styrenes like polystyrene, poly-p-chlorostyrene, polyvinyl toluene and polymers of their substitutes, or copolymers of these with a vinyl compound, polymethyl metacrylate, polybutyl metacrylate, polyvinyl chloride, polyvinyl acetate, polyethylene, polypropylene, polyester, epoxy resins, epoxy polyol resins, polyurethane, polyamides, polyvinyl butyral, polyacrylic resins, rosin, modified rosin, terpene resins, aliphatic and alicyclic hydrocarbon resins, aromatic petroleum resins, chlorinated paraffins, paraffin wax etc. which can be used alone or in combination.

(Charge Controlling Agent)

Specific examples of the charge controlling agent include known charge controlling agents such as Nigrosine dyes, triphenylmethane dyes, metal complex dyes including chromium, chelate compounds of molybdic acid, Rhodaminedyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative) PR, COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among these materials, materials negatively charging a toner are preferably used.

A content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

(Releasing Agent)

A wax for use in the toner of the present invention as a releasing agent has a low melting point of from 50° C. to 120° C. When such a wax is included in the toner, the wax is dispersed in the binder resin and serves as a releasing agent at a location between a fixing roller and the toner particles. Thereby, hot offset resistance can be improved without applying an oil to the fixing roller used. Specific examples of the releasing agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. In addition, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-lauryl-methacrylate and n-stearyl acrylate-ethyl methacrylate copolymers, can also be used.

These charge controlling agent and releasing agents can be dissolved and dispersed after kneaded upon application of heat together with a master batch pigment and a binder resin, and can be added when directly dissolved and dispersed in an organic solvent.

(External Additive)

The inorganic particulate material preferably has a primary particle diameter of from $5\times10^{-3}$ μm to 2 μm, and more preferably from $5\times10^{-3}$ μm to 0.5 μm. In addition, a specific surface area of the inorganic particulates measured by a BET method is preferably from 20 $m^2/g$ to 500 $m^2/g$. The content of the external additive is preferably from 0.01% by weight to 5% by weight, and more preferably from 0.01% by weight to 2.0% by weight, based on total weight of the toner.

Specific examples of the inorganic fine grains are silica, alumina, titanium oxide, barium titanate, magnesium titanate, calcium tiatanate, strontium titanate, zinc oxide, tin oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide, and silicon nitride. Among them, as a fluidity imparting agent, it is preferable to use hydrophobic silica fine grains and hydrophobic titanium oxide fine grains in combination. Particularly, when such two kinds of fine grains, having a mean grain size of $5\times10^{-2}$ μm or below, are mixed together, there can be noticeably improved an electrostatic force and van del Waals force with the toner. Therefore, despite agitation effected in the developing device for implementing the desired charge level, the fluidity imparting agent does not part from the toner grains and insures desirable image quality free from spots or similar image defects. In addition, there can be reduced the amount of residual toner.

Titanium oxide fine grains are desirable in environmental stability and image density stability, but tend to lower in charge start characteristics. Therefore, if the amount of titanium oxide fine particles is larger than the amount of silica fine grains, then the influence of the above side effect is considered to increase. However, so long as the amount of hydrophobic silica fine grains and hydrophobic titanium oxide fine grains is between 0.3% by weight and 1.5% by weight, the charge start characteristics are not noticeably impaired, i.e., desired charge start characteristics are achievable. Consequently, stable image quality is achievable despite repeated copying operation.

The method for manufacturing the toner is described.

The toner of the present invention is produced by the following method, but the manufacturing method is not limited thereto.

(Preparation of Toner)

First, a colorant, unmodified polyester, polyester prepolymer having isocyanate groups and a parting agent are dispersed into an organic solvent to prepare a toner material liquid.

The organic solvent should preferably be volatile and have a boiling point of 100° C. or below because such a solvent is easy to remove after the formation of the toner mother particles. More specific examples of the organic solvent includes one or more of toluene, xylene, benzene, carbon tetrachloride, methylene chloride, 1,2-dichloroethane, 1,1,2-trichloroethane, trichloro ethylene, chloroform, monochlorobenzene, dichloroethylidene, methyl acetate, ethyl acetate, methyl ethyl ketone, methyl isobutyl ketone, and so forth. Particularly, the aromatic solvent such as toluene and xylene; and a hydrocarbon halide such as methylene chloride, 1,2-dichloroethane, chloroform or carbon tetrachloride is preferably used. The amount of the organic solvent to be used should preferably 0 parts by weight to 300 parts by weight for 100 parts by weight of polyester prepolymer, more preferably 0 parts by weight to 100 parts by weight for 100 parts by weight of polyester prepolymer, and even more preferably 25 parts by weight to 70 parts by weight for 100 parts by weight of polyester prepolymer.

Secondly, the toner material liquid is emulsified in an aqueous medium in the presence of a surfactant and organic fine particles.

The aqueous medium for use in the present invention is water alone or a mixture of water with an organic solvent which can be mixed with water. Specific examples of such an organic solvent include alcohols (e.g., methanol, isopropyl alcohol and ethylene glycol), dimethylformamide, tetrahydrofuran, cellosolves (e.g., methyl cellosolve), lower ketones (e.g., acetone and methyl ethyl ketone), etc.

The content of the aqueous medium is typically from 50 parts by weight to 2,000 parts by weight, and preferably from 0.100 parts by weight to 1,000 parts by weight, per 100 parts by weight of the toner constituents. When the content is less than 50 parts by weight, the dispersion of the toner constituents in the aqueous medium is not satisfactory, and thereby the resultant mother toner particles do not have a desired particle diameter. In contrast, when the content is greater than 2,000, the manufacturing costs increase.

Various dispersants are used to emulsify and disperse an oil phase in an aqueous liquid including water in which the toner constituents are dispersed. Specific examples of such dispersants include surfactants, resin fine-particle dispersants, etc.

Specific examples of the dispersants include anionic surfactants such as alkylbenzenesulfonic acid salts, .alpha.-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyldimethylammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycine, di(octylaminoethyle)glycine, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium3-{omega-fluoroalkyl(C6-C11)oxy}-1-alkyl(C3-C4) sulfonate, sodium, 3-lomega-fluoroalkanoyl (C6-C8)-N-ethylamino}-1-propanesulfonate, fluoroalkyl (C11-C20) carboxylic acids and their metal salts, perfluoroalkylcarboxylic acids (7C-13C) and their metal salts, perfluoroalkyl(C4-C12)sulfonate and their metal salts, perfluorooctanesulfonic acid diethanol amides, N-propyl-N-(2-hydroxyethyl-)perfluorooctanesulfone amide, perfluoroalkyl(C6-C10) sulfoneamidepropyltrimethylammonium salts, salts of perfluoroalkyl(C6-C10)-N-ethylsulfonylglycin, monoperfluoroalkyl(C6-C16)e-thylphosphates, etc.

Specific examples of the marketed products of such surfactants having a fluoroalkyl group include SARFRON (trademark registered) S-111, S-112 and S-113, which are manufactured by Asahi Glass Co., Ltd.; FLUORAD (trademark registered) FC-93, FC-95, FC-98 and FC-129, which are manufactured by Sumitomo 3M Ltd.; UNIDYNE (trademark registered) DS-101 and DS-102, which are manufactured by Daikin Industries, Ltd.; MEGAFACE (trademark registered) F-110, F-120, F-113, F-191, F-812 and F-833 which are manufactured by DainipponInk and Chemicals, Inc.; ECTOP EF-102, 103, 104, 105, 112, 123A, 123B, 306A, 501, 201 and 204, which are manufactured by Tohchem Products Co., Ltd.; FUTARGENT (trademark registered) F-100 and F150 manufactured by Neos; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl(C6-C10)sulfone-amidepropyltrimethylammonium salts, benzalkonium salts, benzetonium chloride, pyridinium salts, imidazolinium salts, etc. Specific examples of the marketed products thereof include SARFRON (trademark registered) S-121 (from Asahi Glass Co., Ltd.); FLUORAD (trademark registered) FC-135 (from Sumitomo 3M Ltd.); UNIDYNE DS-202 (from Daikin Industries, Ltd.); MEGAFACE (trademark registered) F-150 and F-824 (from Dainippon Ink and Chemicals, Inc.); ECTOP EF-132 (from Tohchem Products Co., Ltd.); FUTARGENT (trademark registered) F-300 (from Neos); etc.

The resin constituting the fine polymer particles can be any known resin, as long as it can form an aqueous dispersion, and can be either a thermoplastic resin or a thermosetting resin. Specific examples of such resins are vinyl resins, polyurethane resins, epoxy resins, polyester resins, polyamide resins, polyimide resins, silicone resins, phenolic resins, melamine resins, urea resins, aniline resins, ionomer resins, and polycarbonate resins. Each of these resins can be used alone or in combination.

Among them, vinyl resins, polyurethane resins, epoxy resins, polyester resins, and mixtures of these resins are preferred for easily preparing an aqueous dispersion of fine spherical polymer particles.

Examples of the vinyl resins are homopolymers or copolymers of vinyl monomers, such as styrene-acrylic ester resins, styrene-methacrylic ester resins, styrene-butadiene copolymers, acrylic acid-acrylic ester copolymers, methacrylic acid-acrylic ester copolymers, styrene-acrylonitrile copolymers, styrene-maleic anhydride copolymers, styrene-acrylic acid copolymers and styrene-methacrylic acid copolymers. An average particle diameter of the resin constituting the fine polymer particles is preferably from approximately 5 nm to approximately 200 nm, and more preferably from approximately 20 nm to approximately 300 nm.

In addition, inorganic compounds such as tricalcium phosphate, calcium carbonate, titanium oxide, colloidal silica, and hydroxyapatite can be also used as the dispersing agent.

Further, it is possible to stably disperse toner constituents in water using a polymeric protection colloid in combination with the inorganic dispersants and/or particulate polymers mentioned above. Specific examples of such protection colloids include polymers and copolymers prepared using monomers such as acids (e.g., acrylic acid, methacrylic acid, .alpha.-cyanoacrylic acid, .alpha.-cyanomethacrylic acid, itaconic acid, crotonic acid, fumaric acid, maleic acid and maleic anhydride), acrylic monomers having a hydroxyl group (e.g., .beta.-hydroxyethyl acrylate, .beta.-hydroxyethyl methacrylate, .beta.-hydroxypropyl acrylate, (.beta.- hydroxypropyl methacrylate, .gamma.-hydroxypropyl acrylate, .gamma.-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethyleneimine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethylcellulose and hydroxypropylcellulose, can also be used as the polymeric protective colloid.

The dispersion method is not particularly limited, and conventional dispersion facilities, e.g., low speed shearing type, high speed shearing type, friction type, high pressure jet type and ultrasonic type dispersers can be used. Among them, the high speed shearing type dispersion methods are preferable for preparing a dispersion including grains with a grain size of 2 to 20 μm. The number of rotation of the high speed shearing type dispersers is not particularly limited, but is usually 1,000 rpm (revolutions per minute) to 30,000 rpm, and preferably 5,000 rpm to 20,000 rpm. While the dispersion time is not limited, it is usually 0.1 minute to 5 minutes for the batch system. The dispersion temperature is usually 0° C. to 150° C., and preferably 40° C. to 98° C. under a pressurized condition.

At the same time as the production of the emulsion, an amine (B) is added to the emulsion to be reacted with the polyester prepolymer (A) having isocyanate groups.

The reaction causes the crosslinking and/or extension of the molecular chains to occur. The elongation and/or crosslinking reaction time is determined depending on the reactivity of the isocyanate structure of the prepolymer (A) and amine (B) used, but is typically from 10 minnutes to 40 hours, and preferably from 2 hours to 24 hours. The reaction temperature is typically from 0° C. to 150° C., and preferably from 40° C. to 98° C. In addition, a known catalyst such as dibutyltinlaurate and dioctyltinlaurate can be used. The amines (B) are used as the elongation agent and/or crosslinker.

After the above reaction, the organic solvent is removed from the emulsion (reaction product), and the resultant particles are washed and then dried. Thus mother toner particles are prepared.

To remove the organic solvent, the entire system is gradually heated in a laminar-flow agitating state. In this case, when the system is strongly agitated in a preselected temperature range, and then subjected to a solvent removal treatment, fusiform mother toner particles can be produced. Alternatively, when a dispersion stabilizer, e.g., calcium phosphate, which is soluble in acid or alkali, is used, calcium phosphate is preferably removed from the toner mother particles by being dissolved by hydrochloric acid or similar acid, followed by washing with water. Further, such a dispersion stabilizer can be removed by a decomposition method using an enzyme.

Then a charge controlling agent is penetrated into the mother toner particles, and inorganic fine particles such as silica, titanium oxide etc. are added externally thereto to obtain the toner of the present invention.

The penetration of the charge controlling agent and addition of the inorganic fine particles can be carried out using a conventional mixer.

Thus, a toner having a small particle size and a sharp particle size distribution can be obtained easily. Moreover, by controlling the stirring conditions when removing the organic solvent, the particle shape of the particles can be controlled so as to be any shape between perfectly spherical and rugby ball shape. Furthermore, the conditions of the surface can also be controlled so as to be any condition between smooth surface and rough surface such as the surface of pickled plum.

Further, the toner used in the image forming apparatus 1 may be substantially spherical.

Figure 6A:
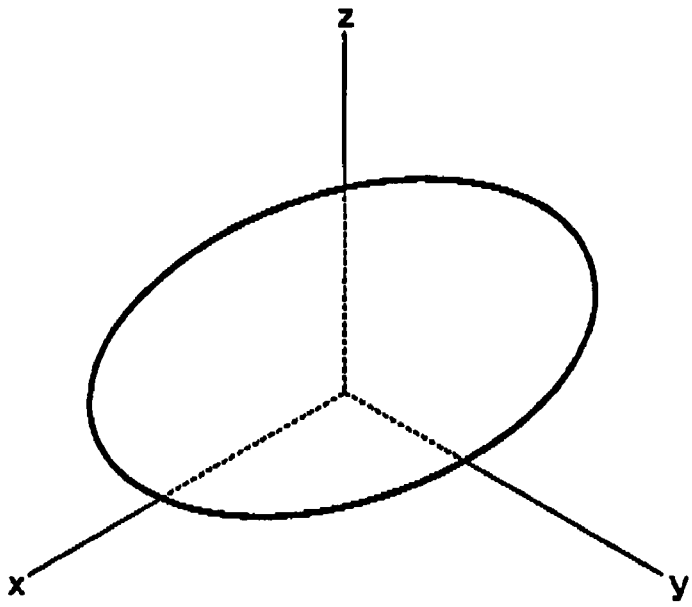
FIG. 6A is an outer shape of a toner used in the image forming unit of FIG. 1, FIGS. 6B and 6C are schematic cross sectional views of the toner, showing major and minor axes and a thickness of FIG. 6A.
Figure 6B:
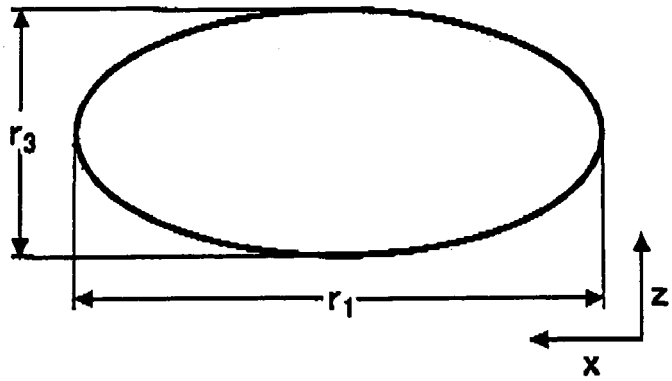
Figure 6C:
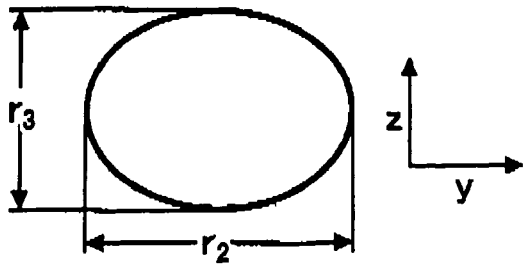

Referring to FIGS. 6A, 6B and 6C, sizes of the toner are described. An axis x of FIG. 6A represents a major axis r1 of FIG. 6B, which is the longest axis of the toner. An axis y of FIG. 6A represents a minor axis r2 of FIG. 6B, which is the second longest axis of the toner. The axis z of FIG. 6A represents a thickness r3 of FIG. 6B, which is a thickness of the shortest axis of the toner. The toner has a relationship between the major and minor axes r1 and r2 and the thickness r3 as follows:

$$r1 \geqq r2 \geqq r3.$$

The toner of FIG. 6A is preferably in a spindle shape in which the ratio (r2/r1) of the major axis r1 to the minor axis r2 is approximately 0.5 to approximately 0.8, and the ratio (r3/r2) of the thickness r3 to the minor axis is approximately 0.7 to approximately 1.0.

When the ratio (r2/r1) is less than approximately 0.5, the toner has an irregular particle shape, and the rates of the dot reproducibility and transfer efficiency may decrease, resulting in degrading image quality.

When the ratio (r3/r2) is less than approximately 0.7, the toner has an irregular particle shape, and the transferability may be degraded compared to transferability obtained with substantially spherical toner particles. When the ratio (r3/r2) is approximately 1.0, the toner has a substantially spherical shape, and the fluidity of toner may increase.

The lengths showing with r1, r2 and r3 can be monitored and measured with scanning electron microscope (SEM) by taking pictures from different angles.

The toner for electro photography of the present invention can be used as a one-component magnetic or non-magnetic toner without a carrier or in combination with magnetic carriers in a two-component developer.

For the two-component developer, the magnetic material used in the carrier includes a ferrite including a bivalent metal like iron, magnetite, Mn, Zn, Cu etc. with a desirable volume average particle size in a range of approximately 20 μm to approximately 100 μm. When the average particle size is smaller than 20 μm, the carrier is easily adhered to the photoconductive element 5 during developing. When the average particle size is greater than 100 μm, the magnetic material doesn't mix well with the toner and the toner is not sufficiently charged, thereby causing defective charging during continuous use. Although it is desirable that the a copper ferrite that includes zinc is used as the magnetic material due to its high saturation magnetization, a suitable magnetic material can be selected according to the process of the printer 1 serving as an image forming apparatus. The resins that coat the magnetic carrier are not limited to any particular resins, but specific examples of the coating resins for the magnetic carrier are silicone resins, styrene-acrylic resins, fluorine resins, olefin resins, and the like. In the method of manufacturing, the coating resin is dissolved in a solvent, sprayed in the fluid bed, and then coated on the core. In another method of manufacturing, the resin particles are electrostatically adhered to the nucleons and are then coated by thermal melting. The thickness of the coated resin is preferably in a range from approximately 0.05 μm to approximately 10 μm, and more preferably from approximately 0.3 μm to approximately 4 μm.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

What is claimed as new and desired to be secured by Letters Patent of the United States is:

1. An image forming apparatus, comprising:

an image bearing member configured to bear an electrostatic latent image on a surface thereof;

a developing mechanism configured to develop the electrostatic latent image formed on the surface of the image bearing member into a toner image with toner;

a transfer mechanism configured to transfer the toner image from the image bearing member to an image receiver; and a cleaning mechanism, comprising:

a cleaning blade configured to scrape a residual toner on the surface of the image bearing member after the toner image has been transferred to the image receiver, the cleaning blade disposed in contact with the image bearing member and having a JIS-A hardness greater than or equal to 70, a repulsion elasticity lesser than or equal to 30% and a modulus of flexural rigidity at a point that is 5 mm away from a fulcrum of the cleaning blade is equal to or greater than 400 mN; and a friction reducing member configured to reduce a coefficient of friction on the surface of the image bearing member.

2. The image forming apparatus according to claim 1, wherein:

the cleaning blade has an elongation at break greater than or equal to 20 MPa of 300% modulus.

3. The image forming apparatus according to claim 1, wherein:

the cleaning blade has an elongation at break greater than or equal to 200% modulus.

4. The image forming apparatus according to claim 1, wherein:

the friction reducing member comprises a brush member disposed in contact with the image bearing member and configured to apply a lubricant to the surface of the image bearing member.

5. The image forming apparatus according to claim 4, wherein:

the cleaning blade is disposed downstream of a contact position of the brush member and the image bearing member in a rotation direction of the image bearing member.

6. The image forming apparatus according to claim 5, wherein:

the brush member is configured to rotate in a same direction as the image bearing member at the contact position with the image bearing member.

7. The image forming apparatus according to claim 1, wherein:

at least the image bearing member and the cleaning mechanism are integrally assembled in a process cartridge detachably attached to the image forming apparatus.

8. The image forming apparatus according to claim 1, further comprising:

a charging mechanism configured to uniformly charge the surface of the image bearing member; and an optical writing mechanism configured to form the electrostatic latent image on the surface of the image bearing member based on image data.

9. The image forming apparatus according to claim 1, wherein:

the image forming apparatus is configured to use as the toner, toner having a volume-based average particle diameter lesser than or equal to 10 μm and a distribution from approximately 1.00 to approximately 1.40; and the distribution is defined by a ratio of the volume-based average particle diameter to a number-based average diameter.

10. The image forming apparatus according to claim 1, wherein:

the image forming apparatus is configured to use as the toner, toner having an average circularity of from approximately 0.93 to approximately 1.00.

11. The image forming apparatus according to claim 1, wherein:

the image forming apparatus is configured to use as the toner, toner having a spindle outer shape, and a ratio of a major axis r1 to a minor axis r2 from approximately 0.5 to approximately 1.0, and a ratio of a thickness r3 to the minor axis r2 from approximately 0.7 to approximately 1.0; and $$r1 \geqq r2 \geqq r3.$$

12. The image forming apparatus according to claim 1, wherein:

the image forming apparatus is configured to use as the toner, toner obtained from at least one of an elongation and a crosslinking reaction of toner composition comprising a polyester prepolymer having a function group including a nitrogen atom, a polyester, a colorant, and a releasing agent in an aqueous medium under resin fine particles.

13. An image forming apparatus, comprising:

means for bearing an electrostatic latent image on a surface thereof;

means for developing the electrostatic latent image formed on the surface of the means for bearing into a toner image with toner;

means for transferring the toner image from the means for bearing to an image receiver; and means for removing, comprising:

means for scraping a residual toner on the surface of the means for bearing after the toner image has been transferred to the image receiver, the means for scraping disposed in contact with the means for bearing and having a JIS-A hardness greater than or equal to 70, a repulsion elasticity lesser than or equal to 30% and a modulus of flexural rigidity at a point that is 5 mm away from a fulcrum of the means for scraping is equal to or greater than 400 mN; and means for reducing a coefficient of friction on the surface of the means for bearing.

14. The image forming apparatus according to claim 13, wherein:

the means for scraping has an elongation at break greater than or equal to 20 MPa of 300% modulus.

15. The image forming apparatus according to claim 13, wherein:

the means for scraping has an elongation at break greater than or equal to 200% modulus.

16. The image forming apparatus according to claim 13, wherein:

the means for reducing comprises means for applying disposed in contact with the means for bearing and for applying a lubricant to the surface of the means for bearing.

17. The image forming apparatus according to claim 16, wherein:

the means for scraping is disposed downstream of a contact position of the means for applying and the means for bearing in a rotation direction of the means for bearing.

18. The image forming apparatus according to claim 17, wherein:

the means for applying is configured to rotate in a same direction as the means for bearing at the contact position with the means for bearing.

19. The image forming apparatus according to claim 13, wherein: at least the means for bearing and the means for removing are integrally assembled in a process cartridge detachably attached to the image forming apparatus.

20. The image forming apparatus according to claim 13, further comprising:

means for charging the surface of the means for bearing; and means for forming the electrostatic latent image on the surface of the means for bearing based on image data.

21. The image forming apparatus according to claim 13, wherein:

the image forming apparatus is configured to use as the toner, toner having a volume-based average particle diameter lesser than or equal to 10 μm and a distribution from approximately 1.00 to approximately 1.40; and the distribution is defined by a ratio of the volume-based average particle diameter to a number-based average diameter.

22. The image forming apparatus according to claim 13, wherein:

the image forming apparatus is configured to use as the toner, the toner having an average circularity of from approximately 0.93 to approximately 1.00.

23. The image forming apparatus according to claim 13, wherein:

the image forming apparatus is configured to use as the toner, toner having a spindle outer shape, a ratio of a major axis r1 to a minor axis r2 from approximately 0.5 to approximately 1.0, and a ratio of a thickness r3 to the minor axis r2 from approximately 0.7 to approximately 1.0; and $$r1 \geqq r2 \geqq r3.$$

24. The image forming apparatus according to claim 13, wherein:

the image forming apparatus is configured to use as the toner, the toner obtained from at least one of an elongation and a crosslinking reaction of toner composition comprising a polyester prepolymer having a function group including a nitrogen atom, a polyester, a colorant, and a releasing agent in an aqueous medium under resin fine particles.

25. A method of forming an image, comprising:

charging a surface of an image bearing member;

forming an electrostatic latent image on the surface of the image bearing member based on image data;

developing the electrostatic latent image formed on the surface of the image bearing member into a toner image with toner;

transferring the toner image from the image bearing member to an image receiver;

removing a residual toner on the surface of the image bearing member after the toner image is transferred to the image receiver with a cleaning blade disposed in contact with the image bearing member and having a JIS-A hardness greater than or equal to 70, a repulsion elasticity lesser than or equal to 30% and a modulus of flexural rigidity at a point that is 5 mm away from a fulcrum of the cleaning blade is equal to or greater than 400 mN; and applying a lubricant on the surface of the image bearing member.

26. The method according to claim 25, wherein:

the cleaning blade has an elongation at break greater than or equal to 20 MPa of 300% modulus.

27. The method according to claim 25, wherein: the cleaning blade has an elongation at break greater than or equal to 200% modulus.

28. The method according to claim 25, wherein:

the applying comprises rotating a brush member in a same direction as the image bearing member at the contact position with the image bearing member.

29. A cleaning mechanism, comprising:

a cleaning blade configured to scrape a residual toner on a surface of an image bearing member after a toner image has been transferred to an image receiver, the cleaning blade disposed in contact with the image bearing member and having a JIS-A hardness greater than or equal to 70, a repulsion elasticity lesser than or equal to 30% and a modulus of flexural rigidity at a point that is 5 mm away from a fulcrum of the cleaning blade is equal to or greater than 400 mN; and a friction reducing member configured to reduce a coefficient of friction on the surface of the image bearing member.

30. The cleaning mechanism according to claim 29, wherein:

the cleaning blade has an elongation at break greater than or equal to 20 MPa of 300% modulus.

31. The cleaning mechanism according to claim 29, wherein the cleaning blade has an elongation at break greater than or equal to 200% modulus.

32. The cleaning mechanism according to claim 29, wherein:

the friction reducing member comprises a brush member disposed in contact with the image bearing member and configured to apply a lubricant to the surface of the image bearing member.

33. The cleaning mechanism according to claim 32, wherein:

the cleaning blade is disposed downstream of a contact position of the brush member and the image bearing member in a rotation direction of the image bearing member.

34. The cleaning mechanism according to claim 33, wherein:

the brush member is configured to rotate in a same direction as the image bearing member at the contact position with the image bearing member.

35. A cleaning mechanism, comprising:

means for scraping a residual toner on a surface of an image bearing member after a toner image is transferred to an image receiver, the means for scraping disposed in contact with mean for bearing and having a JIS-A hardness greater than or equal to 70, a repulsion elasticity lesser than or equal to 30% and a modulus of flexural rigidity at a point that is 5 mm away from a fulcrum of the means for scraping is equal to or greater than 400 mN; and means for reducing a coefficient of friction on the surface of the means for bearing.

36. The cleaning mechanism according to claim 35, wherein:

the means for scraping has an elongation at break greater than or equal to 20 MPa of 300% modulus.

37. The cleaning mechanism according to claim 35, wherein:

the means for scraping has an elongation at break greater than or equal to 200% modulus.

38. The cleaning mechanism according to claim 35, wherein:

the means for reducing comprises means for applying disposed in contact with the means for bearing and for applying a lubricant to the surface of the means for bearing.

39. The cleaning mechanism according to claim 38, wherein:

the means for scraping is disposed downstream of a contact position of the means for applying and the means for bearing in a rotation direction of the means for bearing.

40. The cleaning mechanism according to claim 39, wherein:

the means for applying is configured to rotate in a same direction as the means for bearing at the contact position with the means for bearing.

41. A process cartridge detachably attached to an image forming apparatus, comprising:

an image bearing member configured to bear an image on a surface thereof; and a cleaning mechanism, comprising:

a cleaning blade configured to scrape a residual toner on the surface of the image bearing member after the image has been transferred to an image receiver, the cleaning blade disposed in contact with the image bearing member and having a JIS-A hardness greater than or equal to 70, a repulsion elasticity lesser than or equal to 30% and a modulus of flexural rigidity at a point that is 5 mm away from a fulcrum of the cleaning blade is equal to or greater than 400 mN; and a friction reducing member configured to reduce a coefficient of friction on the surface of the image bearing member.

42. The process cartridge according to claim 41, wherein:

the cleaning blade has an elongation at break greater than or equal to 20 MPa of 300% modulus.

43. The process cartridge according to claim 41, wherein:

the cleaning blade has an elongation at break greater than or equal to 200% modulus.

44. The process cartridge according to claim 41, wherein:

the friction reducing member comprises a brush member disposed in contact with the image bearing member and configured to apply a lubricant to the surface of the image bearing member.

45. The process cartridge according to claim 44, wherein:

the cleaning blade is disposed downstream of a contact position of the brush member and the image bearing member in a rotation direction of the image bearing member.

46. The process cartridge according to claim 45, wherein:

the brush member is configured to rotate in a same direction as the image bearing member at the contact position with the image bearing member.

47. A process cartridge detachably attached to an image forming apparatus, comprising:

means for bearing an electrostatic latent image on a surface thereof; and means for removing, comprising:

means for scraping a residual toner on the surface of the means for bearing after the image is transferred to an image receiver, the means for scraping disposed in contact with the means for bearing and having a JIS-A hardness greater than or equal to 70, a repulsion elasticity lesser than or equal to 30% and a modulus of flexural rigidity at a point that is 5 mm away from a fulcrum of the means for scraping is equal to or greater than 400 mN; and means for reducing a coefficient of friction on the surface of the means for bearing.

48. The process cartridge according to claim 47, wherein:

the means for scraping has an elongation at break greater than or equal to 20 MPa of 300% modulus.

49. The process cartridge according to claim 47, wherein:

the means for scraping has an elongation at break greater than or equal to 200% modulus.

50. The process cartridge according to claim 47, wherein:

the means for reducing comprises a means for applying disposed in contact with the means for bearing and configured to apply a lubricant to the surface of the means for bearing.

51. The process cartridge according to claim 50, wherein:

the means for scraping is disposed downstream of a contact position of the means for applying and the means for bearing in a rotation direction of the means for bearing.

52. The process cartridge according to claim 51, wherein:

the means for applying is configured to rotate in a same direction as the means for bearing at the contact position with the means for bearing.

* * * * *